United States Patent [19]

Sawata et al.

[11] 4,116,266

[45] Sep. 26, 1978

[54] APPARATUS FOR HEAT TRANSFER

[75] Inventors: Shinji Sawata, Higashi-Murayama; Tatsuo Tani, Koganei; Tadayoshi Tanaka; Takashi Horigome, both of Tanashi, all of Japan

[73] Assignee: Agency of Industrial Science & Technology, Tokyo, Japan

[21] Appl. No.: 824,513

[22] Filed: Aug. 15, 1977

Related U.S. Application Data

[62] Division of Ser. No. 600,564, Jul. 31, 1975, abandoned.

[30] Foreign Application Priority Data

Aug. 2, 1974 [JP] Japan ..... 49-88116

[51] Int. Cl.[2] ..... F28D 15/00

[52] U.S. Cl. ..... 165/105; 122/366; 138/40

[58] Field of Search ..... 165/105; 138/40; 122/366

[56] References Cited

U.S. PATENT DOCUMENTS

| | | | |
|---|---|---|---|
| 3,528,494 | 9/1970 | Levedahl | 165/105 |
| 3,786,861 | 1/1974 | Eggers | 165/105 |
| 3,901,311 | 8/1975 | Kosson et al. | 165/105 |
| 4,018,269 | 4/1977 | Honda et al. | 165/105 |

*Primary Examiner*—Albert W. Davis, Jr.
*Attorney, Agent, or Firm*—Oblon, Fisher, Spivak, McClelland & Maier

[57] ABSTRACT

Apparatus for heat transfer is disclosed. This apparatus is a closed container which is possessed of an input portion and an output portion for heat energy and is provided on the inside thereof with a wick extending throughout from the input portion to the output portion and disposed so that the resistance offered thereby to the flow of liquid gradually decreases from the input side to the output side. The heat medium which is vaporized on the input side is moved in the direction of the output side by virtue of the difference of pressure created inside the container. The heat medium which is deprived of heat and consequently liquefied on the output side is moved within the wick in the direction of the input side by virtue of capillary action coupled with the suction resulting from the vaporization of the heat medium in the input portion. As the temperature on the input side falls below that on the output side, the movement of the heat medium in the direction of the input side discontinues because of the stop of the vaporization of the heat medium on the input side and the directionality of the resistance offered by the wick to the flow of liquid, preventing otherwise possible reverse flow of the heat energy.

3 Claims, 10 Drawing Figures

APPARATUS FOR HEAT TRANSFER

This is a division of application Ser. No. 600,564 filed July 31, 1975 now abandoned.

BACKGROUND OF THE INVENTION

The present invention relates to an apparatus for heat transfer. More particularly, this invention relates to an apparatus for heat transfer of the type which precludes possible reverse flow of heat energy even when the temperature on the input side falls below that on the output side.

The heat pipe which has heretofore been used as one form of heat transfer means will be explained. The heat pipe is a device employed for effecting the transfer of heat by utilizing capillary action in conjunction with the difference of pressure created inside the pipe. On the input side (heat-absorption portion) of the heat pipe, the heat medium absorbs heat and is consequently vaporized and the vaporized heat medium is moved in the direction of the output side (heat-radiation portion) by virtue of the difference of pressure. On the output side, the heat medium liberates heat and is consequently liquefied. The liquefied heat medium is now made to flow through the wick inside the heat pipe back to the input side by virtue of capillary action coupled with the suction resulting from the vaporization of the heat medium on the input side. Because of the difference of pressure resulting from the difference of temperature between the input side and the output side, the heat medium which is vaporized on the input side is made to move from the input side to the output side. When the heat pipe in which the heat medium is moved by virtue of the difference of pressure as described above is used in a heat-absorption device such as a solar energy absorption device which experiences abrupt changes of input energy, however, there is entailed a possibility that reverse flow of heat medium will occur when the heat energy on the input side of the heat pipe decreases sharply and the temperature on the input side falls below that on the output side.

An object of the present invention is to provide an apparatus for heat transfer of the type which precludes otherwise possible reverse flow of heat energy even when the temperature on the input side falls below that on the output side.

SUMMARY OF THE INVENTION

To accomplish the object described above, the apparatus for heat transfer according to the present invention comprises a closed container in the shape of a pipe possessed of a heat energy input portion at one end thereof and a heat energy output portion at the other end thereof, a wick disposed inside the interior of said closed container throughout from the input side to the output side thereof and a heat medium sealed in said closed container, whereby the heat medium is moved in its liquid state inside the wick from the output side to the input side by virtue of capillary action, is vaporized by the heat absorbed by the input portion, is then moved in the vaporized state in the direction of the output side by virtue of the difference of pressure created inside the closed container, and is liquefied by the liberation of heat by the output portion, which apparatus for heat transfer is characterized by having said wick so disposed that the resistance offered thereby to the flow of liquid gradually decreases from the input side to the output side.

To be more specific, if a multiplicity of channels dug in the inner surface of the container are used to serve as the wick, the width and/or depth of the individual channels is gradually increased in the direction from the input side to the output side. Where a bundle of fine metal wires laid along the axis of the container is used to play the part of said wick, the thickness of the individual metal wires is gradually increased or the number of said fine metal wires is gradually increased in the direction of the output side.

In the apparatus for heat transfer provided with a wick like the one described above, when heat energy is introduced through the input portion, it causes the heat medium to be vaporized. The vaporized heat medium is moved from the input side to the output side by virtue of the difference of pressure resulting from the difference of temperature created inside the container. On arrival at the output portion, the heat medium liberates heat and is consequently liquefied and adsorbed on the wick. The liquid heat medium which is now inside the wick is successively moved in the direction of the input side by virtue of capillary action within the wick coupled with the suction owing to the vaporization of the liquefied heat medium in the input portion. When the temperature in the input portion falls below that in the output portion, the vaporization of the liquefied heat medium in the input portion ceases and the transfer of the liquefied heat medium inside the wick in the direction of the input side fails to continue because the resistance offered by the wick to the flow of liquid increases in the direction of the input side. Consequently, possible reverse flow of heat energy inside the container is prevented.

The other objects and characteristic features of the present invention will become apparent from the description to be given in further detail herein below with reference to the accompanying drawing.

DETAILED DESCRIPTION OF THE INVENTION

The heat pipes which have heretofore been used as means for heat transfer are broadly divided into two types; one type with a construction having a wick formed on the inner surface of heat pipe and the other type with a construction having a wick disposed along the axis of heat pipe.

The heat pipe of the former type will now be described with reference to FIG. 1. A wick 2 is formed on the inner surface of a closed container 1 in the shape of a pipe. Means for heat absorption (input side) 5 is disposed at one end of the container and means for heat liberation (output side) 6 at the other end thereof.

Figure 1A:
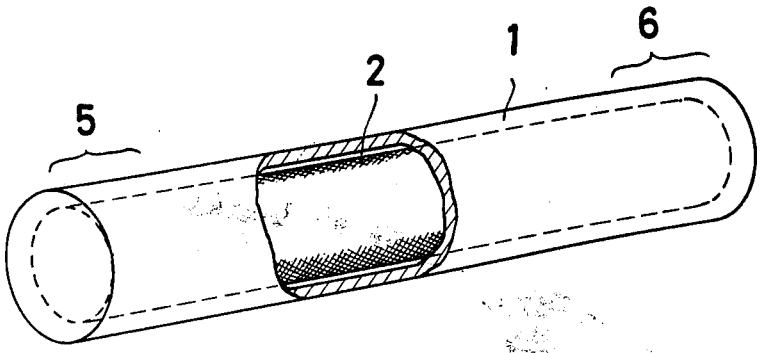
FIGS. 1(A), (B) and (C) are perspective views of conventional heat pipes, with a portion of each cut away to illustrate the internal construction thereof.
Figure 1B:
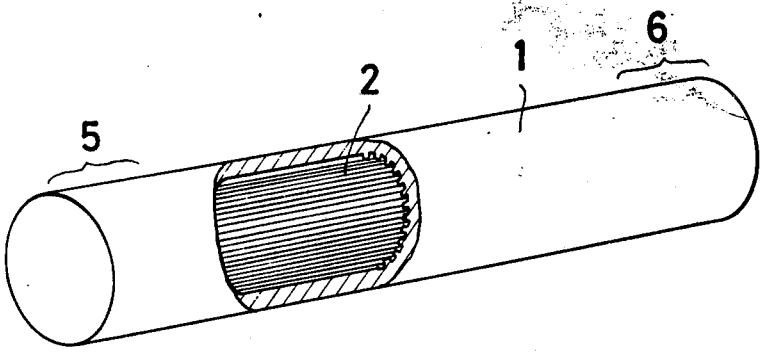
Figure 1C:
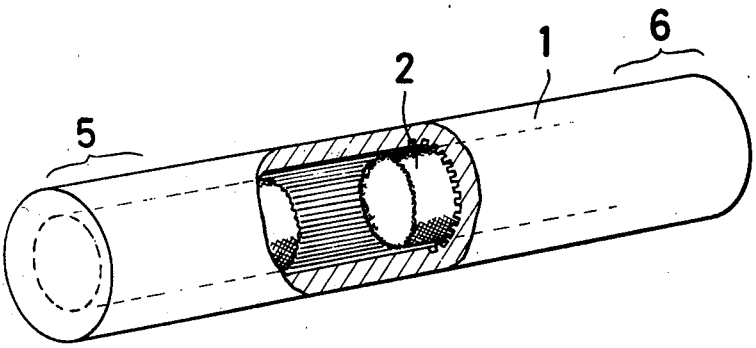

FIGS. 1(A) to (C) illustrate typical embodiments of the conventional wick: FIG. 1(A) is an example of a screen wick 2 in which a fine-mesh gauze is attached to the inner surface of the container 1, FIG. 1(B) an example of an open channel wick in which a multiplicity of fine grooves 2 are dug in the inner wall in the axial direction of the container 1 and FIG. 1(C) an example of a composite wick 2 in which a gauze is attached to and a multiplicity of fine grooves are dug in the inner surface of the container.

In the heat pipes of the constructions such as are described above, when heat is introduced on the input side 5, the temperature on the input side 5 is elevated and the heat medium within the wick on the input side 5 absorbs the heat and is consequently vaporized to increase the pressure. In the meantime on the output side, the heat is liberated and the temperature is lowered, with the result that the vaporized heat medium is condensed and liquefied and the pressure is lowered. By virtue of the difference of pressure created between the input side 5 and the output side 6, the vaporized heat medium is moved through the vapor path running along the axis of the heat pipe in the direction of the output side 6. As described above, the vaporized heat medium is deprived of heat on the output side and is consequently condensed and converted into a liquid, which is adsorbed on the wick 2 in the output portion. The liquefied heat medium is now returned to the wick by virtue of the capillarity of the wick and the suction due to the vaporization of the heat medium on the input side. As this process of heat flow is repeated, the heat introduced on the input side is transferred to the output side through the pipe interior. The heat medium is suitably selected from among water, ammonia, cesium, potassium and sodium, and due consideration paid to the particular range of temperatures of the heat desired to be transferred.

Figure 2A:
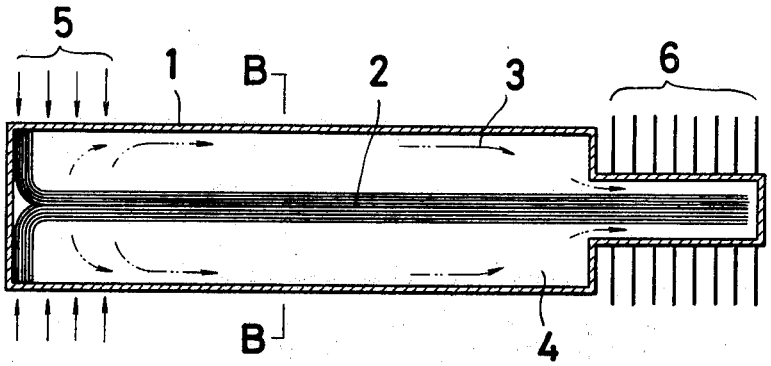
FIG. 2(A) is a longitudinal section illustrating one modification of the conventional heat pipe.
Figure 2B:
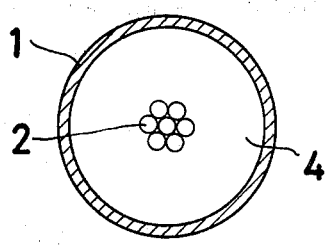
FIG. 2(B) is an enlarged cross section taken along B—B in FIG. 2(A).

The latter type of known heat pipe having the wick disposed along the axis of the pipe will now be described with reference to FIGS. 2(A) and (B). A multiplicity of stainless steel wires of a diameter of 4 to 100 μm are bundled and this bundle of fine wires wick 2 is extended along the axis of the closed container 1. At the end of the input side 5 of said container, the individual fine wires are bent in the circumferential direction.

When heat is introduced on the input side 5, the temperature on the input side is elevated and the heat medium 3 is vaporized. The vaporized heat medium is moved along the inner surface of the container in the direction of the output side 6. On arrival at the output side, the vaporized heat medium is deprived of its heat and consequently converted into a liquid, which adheres to the bundle of fine wires 2 on the output side. The liquid heat medium adsorbed on the wick is moved toward the input side by virtue of the surface tension due to the capillarity of the wick and the suction due to the vaporization of the heat medium on the input side 5. In this type of heat pipe, the movement of the vaporized heat medium is accomplished easily and efficiently because the path 4 for vapor is formed between the wick and the inner surface of the closed container 1.

Since the conventional type of heat pipe has a construction such as described above, the pressure on the input side is greater than that on the output side and the heat medium is caused to move to the output side to effect the desired transfer of heat energy insofar as the temperature on the input side is higher than that on the output side. If the temperature on the input side falls below that on the output side, however, there is a possibility of the heat energy being transferred reversely from the output side to the input side. This constitutes a drawback for the conventional heat pipe.

The present invention aims to provide an apparatus for heat transfer which is free from said drawback of possible reverse flow of heat energy. One preferred embodiment of the apparatus of this invention will be explained with reference to FIG. 3(A), (B) and (C) and FIG. 4(A) and (B).

Figure 3A:
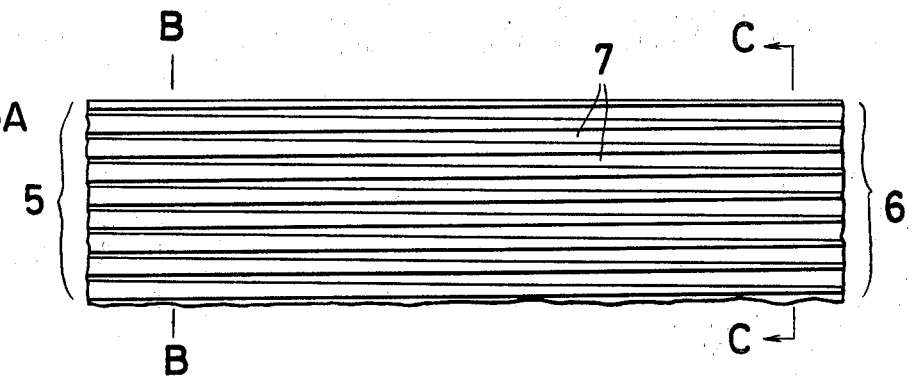
FIG. 3(A) is a developed view of one part of the channels forming a wick in accordance with one preferred embodiment of the present invention.

In the embodiment shown in FIG. 3(A) and FIG. 4(A), a multiplicity of channels 7 of a fixed depth and a width gradually increasing in the direction from the input side 5 to the output side 6 are dug in the inner surface of a pipe-shaped closed container 1 which is provided on the input side 5 with means for heat absorption and on the output side 6 with means for heat liberation. The width of the individual channels is ordinarily on the order of 1mm with the width at the output side being two to five times that at the input side. Thus the width at the input side ranges between about 0.2 and 1.0mm while that at the output side ranges between about 0.7 and 5.0mm. When the width of the channels at the input side is made less than one-fifth that at the output side, the resistance to liquid flow in the direction of the input side becomes excessively large and return of liquid medium to the input side is apt to become insufficient. On the other hand, when the width of the channels at the input side is made larger than one-half that at the output side, the resistance to liquid flow in the direction of the input side becomes too small to prevent reversal of heat flow at the time the temperature at the input side drops below that at the output side.

Figure 3B:
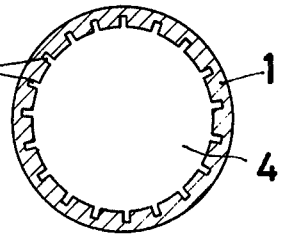
FIG. 3(B) is a cross section of the heat pipe represented in FIG. 3(A) illustrating the configuration of the wick channels in the vicinity of the line B—B.
Figure 3C:
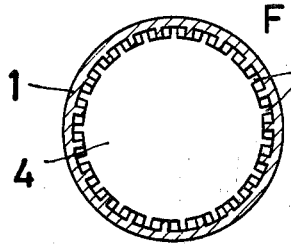
FIG. 3(C) is a cross section of the heat pipe represented in FIG. 3(A) illustrating the configuration of the wick channels in the vicinity of the line C—C.
Figure 4:
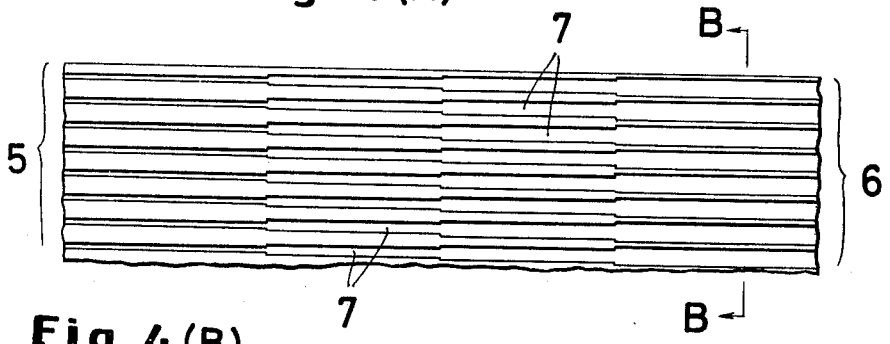
FIG. 4(A) is a developed view of one part of the channels forming a wick in accordance with another preferred embodiment of the present invention.
FIG. 4(B) is a cross section of the heat pipe represented in FIG. 4(A) illustrating the configuration of the channels in the vicinity of the line B—B.
Figure 4:
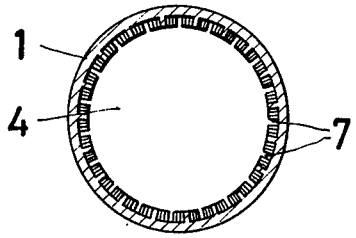

The channel width may increase continuously as illustrated in FIG. 3 or stepwise as illustrated in FIG. 4. Inside the closed container, a heat medium is sealed similarly to the conventional heat pipe. The material of the container and the substance of the heat medium may be exactly the same as those used in the conventional heat pipe. For example, the material of the container can be selected from among copper, aluminum, steel etc. while the heat medium can be selected from among water, ammonium, potassium, calcium etc.

Figure 6A:
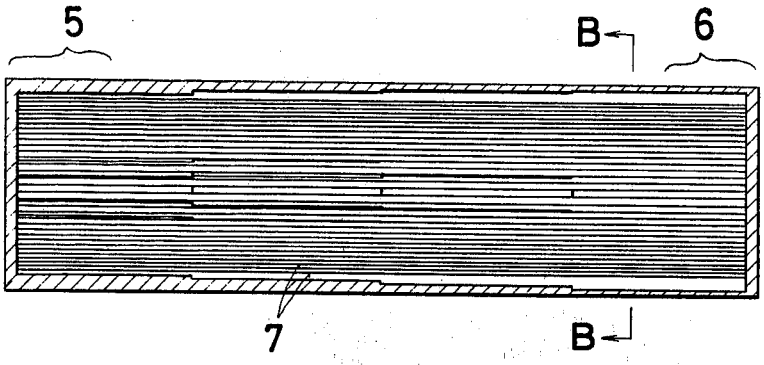
FIG. 6(A) is a longitudinal sectional view of still another preferred embodiment of the present invention wherein the depth of the wick grooves is increased stepwise.
Figure 6B:
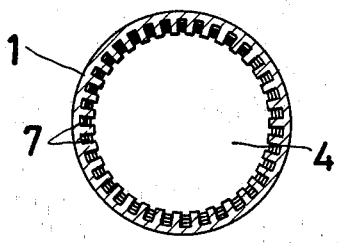
FIG. 6(B) is a cross section taken along line B—B in FIG. 6(A).
Figure 5:
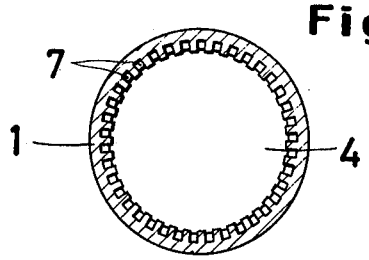
FIG. 5(A) is a longitudinal sectional view of still another preferred embodiment of the present invention wherein the wick grooves are formed with gradually increasing depth.
FIG. 5(B) is a cross section taken along line B—B in FIG. 5(A).
Figure 5:
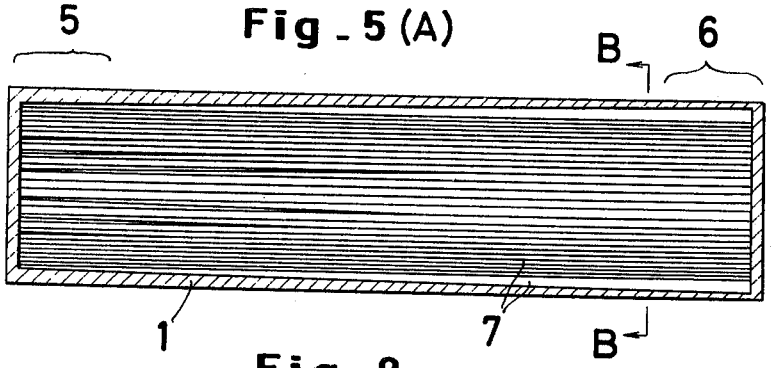

FIGS. 5(A) and (B) and FIGS. 6(A) and (B) represent another preferred embodiment of the apparatus for heat transfer according to the present invention. In this embodiment, a multiplicity of channels 7 of a fixed width and a depth increasing toward the output side 6 are dug in the inner surface of a pipe-shaped closed container 1. Said depth of the individual channels 7 may increase continuously as illustrated in FIG. 5 or stepwise as illustrated in FIG. 6. A heat medium is sealed in said closed container. Similarly to the preceding embodiment, the depth of the channels at the output side are two to five times that at input side.

In the heat transfer apparatus for the type which has a multiplicity of channels so adapted that the resistance offered thereby to the flow of liquid with the decreasing distance from the output side, when heat energy is introduced on the input side, the heat medium is vaporized by the heat and is consequently moved through the vapor path toward the output side, similarly to the conventional heat pipe, by virtue of the difference of pressure created inside the container. On arrival at the output side, the vaporized heat medium is deprived of heat and consequently converted into a liquid state and, in that state, adsorbed on the channels formed in the inner surface of the container. The liquefied heat medium thus adhering to said channels is caused to move toward the input side by virtue of capillary action. On reaching the input side, the liquefied heat medium within the channels is successively vaporized once again and is caused to move in the direction of the output side. The process of the movement of the heat medium from the input side to the output side and back described above is equal to that involved in the known heat pipe.

When the input heat energy either decreases or stops and the temperature on the input side consequently falls below that on the output side, however, the liquefied heat medium inside the channels is not vaporized as it approaches the input side and, since the shape of the individual channels are such that the resistance offered to the flow of liquid increases in proportion as the distance from the input side decreases, the liquefied heat medium remains intact within the channels. Under this condition, it is practically impossible for the heat energy to be transferred from the output side to the input side.

The heat transfer apparatus according to the present invention enables the input heat energy to be easily transferred to the output side as described above. When the temperature on the input side falls below that on the output side, this apparatus does not permit the heat energy to flow reversely but continues to fulfill its part as a heat valve. In this respect, it differs from the conventional heat pump.

Figure 7A:
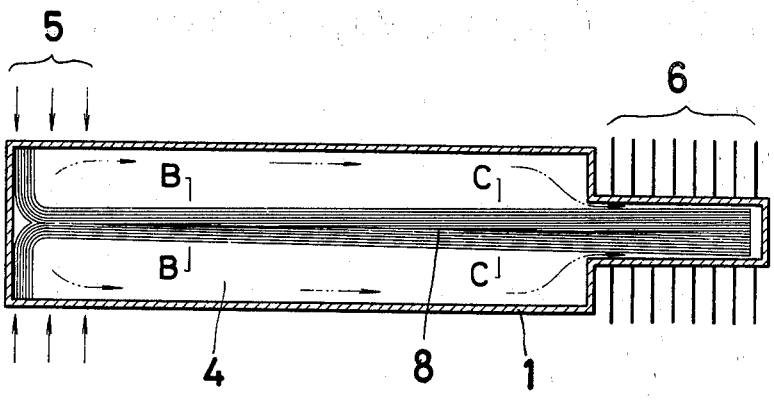
FIG. 7(A) is a longitudinal section of still another preferred embodiment of the present invention wherein the wick is formed of wires of gradually increasing diameter.
Figure 7B:
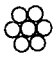
FIG. 7(B) is a cross section taken along lines B—B in FIG. 7(A) showing the configuration of the wick in the vicinity of one end thereof.
Figure 7C:
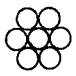
FIG. 7(C) is a cross section taken along line C—C in FIG. 7(A) showing the configuration of the wick in the vicinity of its other end.

FIG. 7 shows still another preferred embodiment of the apparatus according to the present invention. In this embodiment, a bundle of fine metal wires 8 the diameter of which gradually increases from the input side 5 to the output side 6 is disposed as the wick along the axis of a pipe-shaped closed container 1 which is provided with means from heat absorption and means for heat liberation at the opposed ends thereof. The diameter of the individual wires is thus between 10 and 100 μm at the input side and between 50 and 500 μm at the output side. The void which occurs between the individual fine metal wires 8 in the bundle formed as described above increases gradually from the input side to the output side and, therefore, the resistance offered to the flow of liquid gradually decreases toward the output side.

In the heat transfer apparatus which is provided with the wick of a construction such as is described above, the heat medium vaporized on the input side is allowed to move toward the output side through the space formed between the wick and the inner surface of the container insofar as the temperature on the input side is higher than that on the output side. Then, the heat medium deprived of heat and consequently liquefied on the output side is successively moved within the wick toward the input side by virtue of the suction due to the vaporization of the heat medium on the input side.

When the temperature on the input side falls below that on the output side, however, the liquefied heat medium encounters by gradually increasing resistance as it flows toward the input side. Moreover, since the vaporization of the heat medium on the input side no longer proceeds under such condition, the movement of the liquefied heat medium is all the more impeded. For this reason, it becomes practically impossible for the transfer of heat energy to be reversed in its direction.

Figure 8:
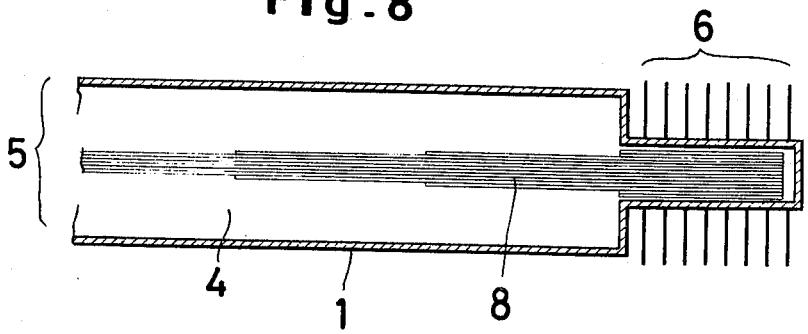
FIG. 8 is a longitudinal sectional view of still another preferred embodiment of the present invention wherein the wick is formed of wires which decrease in number toward one end.

In the embodiment just described, a bundle of fine metal wires wherein the thickness of the individual wires is varied by a fixed rule is used as the wick. An effect similar to that obtainable by the wick of FIG. 7 can be obtained by using, as the wick, a bundle of fine metal wires 8 wherein the thickness of the individual wires is fixed and the number of the individual wires is gradually decreased in proportion as the distance to the input side 5 decreases as illustrated in FIG. 8. For example, if the number of wires at the output side is 7000, this number is decreased gradually toward the input side becoming finally 1000 to 3000. So decreasing the number of wires toward the input side results in a decrease in the number of passages formed among the wires and a substantial increase in resistance to liquid flow toward the input end. The fine metal wires which are bundled to form the wick can be made of stainless steel.

In the heat transfer apparatus according to the present invention, the wick is so constructed that the resistance offered thereby to the flow of liquid gradually decreases in the direction from the input side to the output side as is clear from the foregoing description. While the temperature on the input side is higher than that on the output side, therefore, the heat medium which has been liquefied on the output side smoothly moves within the wick toward the input side by virtue of the suction due to the vaporization of the heat medium in the input side, notwithstanding that the resistance offered by the wick to the flow of liquid gradually increases in the direction of the input side. When the temperature on the input side falls below that on the output side, the vaporization of the heat medium ceases to proceed. Because of the discontinued vaporization coupled with the increased resistance of the wick to the flow of liquid, the heat medium is now allowed to move within the wick toward the input side. This means that the apparatus does not permit reverse flow of heat energy under any temperature conditions.

The apparatus for heat transfer according to the present invention has a very simple construction and is quite easy to manufacture. And it can be utilized advantageously as a heat transfer apparatus in a system for the absorption of heat energy such as solar energy which is readily variable.

What is claimed is:

1. In an apparatus for heat transfer comprising a closed container in the shape of a pipe possessed of a heat energy input portion at one end thereof and a heat energy output portion at the other end thereof, a bundle of a multiplicity of fine metal wires disposed along the axis of said closed container extending from the input side to the output side thereof, and a heat medium sealed in said closed container, whereby the heat medium is moved in its liquid state inside the bundle through the passages formed between said multiplicity of fine metal wires from the output side to the input side by the suction due to vaporization of the heat medium on the input side, vaporized by the heat absorbed in the input portion, then moved in the vaporized state in the direction of the output side through the space formed between the bundle and the inner surface of the container by virtue of the difference of pressure created inside the closed container, and liquefied by the liberation of heat in the output portion, an improvement wherein said bundle is formed to provide passages between said multiplicity of fine metal wires having a gradually increasing cross-sectional area from the input side to the output side so that the resistance offered thereby to the flow of liquid gradually decreases in the direction from the input side to the output side.

2. The apparatus for heat transfer according to claim 1, wherein the individual fine wires making up said bundle are gradually increased in thickness in the direction from the input side to the output side.

3. The apparatus for heat transfer according to Claim 1, wherein the thickness of the individual fine wires making up said bundle is fixed and the number of said individual fine wires is increased gradually in the direction from the input side to the output side.

* * * * *